US007506643B2

(12) United States Patent
Holmberg

(10) Patent No.: US 7,506,643 B2
(45) Date of Patent: Mar. 24, 2009

(54) CROSSBOW DEVICE MOUNT

(76) Inventor: Larry Holmberg, P.O. Box 63, Wascott, WI (US) 54890

( * ) Notice: Subject to any disclaimer, the term of this patent is extended or adjusted under 35 U.S.C. 154(b) by 80 days.

(21) Appl. No.: 11/479,610

(22) Filed: Jun. 30, 2006

(65) Prior Publication Data

US 2008/0000463 A1 Jan. 3, 2008

(51) Int. Cl.
*F41B 5/12* (2006.01)
*F41B 5/00* (2006.01)

(52) U.S. Cl. ..... 124/86; 124/25; 124/87; 33/265

(58) Field of Classification Search ..... 124/23.1, 124/25, 86, 87; 33/265
See application file for complete search history.

(56) References Cited

U.S. PATENT DOCUMENTS

| | | | | |
|---|---|---|---|---|
| 0,521,761 | A | 6/1894 | Day | |
| 0,899,639 | A | 8/1908 | Vibber | |
| 1,480,147 | A | 1/1924 | Fokko | |
| 2,101,479 | A | 12/1937 | Schenk | |
| 2,450,466 | A | 10/1948 | Carlson | |
| 2,814,118 | A | 11/1957 | Evans et al. | |
| 3,427,102 | A | 2/1969 | Wade | |
| 3,483,623 | A | 12/1969 | Kruzell | |
| 3,684,376 | A | 8/1972 | Lessard | |
| 3,782,822 | A | 1/1974 | Spence | |
| 3,785,261 | A | 1/1974 | Ganteaume | |
| 3,834,052 | A * | 9/1974 | Steck, III | 42/90 |
| 4,027,414 | A | 6/1977 | Felix | |
| 4,233,770 | A | 11/1980 | de Filippis et al. | |
| T101,001 | I4 | 9/1981 | Shipp et al. | |
| 4,296,725 | A | 10/1981 | Broderick | |
| D268,910 | S | 5/1983 | Shipp et al. | |
| 4,514,907 | A | 5/1985 | Saltzman | |
| 4,516,296 | A | 5/1985 | Sherman | |
| 4,531,052 | A | 7/1985 | Moore | |
| 4,597,211 | A | 7/1986 | Miles | |
| 4,606,629 | A | 8/1986 | Hines et al. | |
| 4,617,741 | A | 10/1986 | Bordeaux et al. | |
| 4,640,258 | A | 2/1987 | Penney et al. | |
| 4,643,159 | A | 2/1987 | Ryan | |
| 4,730,190 | A | 3/1988 | Win et al. | |
| 4,753,528 | A | 6/1988 | Hines et al. | |
| 4,777,352 | A | 10/1988 | Moore | |
| 4,786,204 | A | 11/1988 | Mayeda | |
| 4,786,966 | A | 11/1988 | Hanson et al. | |
| 4,835,621 | A | 5/1989 | Black | |
| 4,839,863 | A | 6/1989 | Soneda | |
| 4,884,137 | A | 11/1989 | Hanson et al. | |
| 4,890,128 | A * | 12/1989 | Kania | 396/426 |

(Continued)

FOREIGN PATENT DOCUMENTS

| | | | |
|---|---|---|---|
| EP | 1804017 | A1 | 7/2007 |

(Continued)

*Primary Examiner*—John Ricci
(74) *Attorney, Agent, or Firm*—Sherrill Law Offices, PLLC

(57) ABSTRACT

A device mount system is provided that is designed to mount a device used in hunting, such as a video camera, rangefinder, game caller or the like, to a crossbow. The mount system includes a device mount. The device mount has a support portion and a side portion. The support portion is adapted to be coupled to the device. The side portion is adapted to be coupled to a scope on the crossbow.

12 Claims, 5 Drawing Sheets

U.S. PATENT DOCUMENTS 4,910,717 A 3/1990 Terry
4,939,863 A 7/1990 Alexander et al.
4,970,589 A 11/1990 Hanson et al.
4,974,575 A 12/1990 Mitchell
D313,361 S 1/1991 Robinson
4,993,833 A 2/1991 Lorey et al.
4,996,866 A 3/1991 Masera et al.
5,005,213 A 4/1991 Hanson et al.
5,020,262 A 6/1991 Pena
5,026,158 A 6/1991 Golubic
5,033,219 A 7/1991 Johnson et al.
5,161,310 A 11/1992 Stoot
5,200,827 A 4/1993 Hanson et al.
5,297,533 A 3/1994 Cook
5,373,657 A 12/1994 Betz et al.
5,456,157 A 10/1995 Lougheed et al.
5,479,712 A 1/1996 Hargrove et al.
5,520,164 A 5/1996 Huddleston
D371,084 S 6/1996 Ogawa
5,531,149 A 7/1996 Schubert et al.
5,575,072 A 11/1996 Eldridge
5,611,324 A 3/1997 Kursinsky
5,669,174 A 9/1997 Teetzel
5,686,690 A 11/1997 Lougheed et al.
5,687,910 A 11/1997 King
5,711,104 A 1/1998 Schmitz
D390,483 S 2/1998 Zykan et al.
5,815,251 A 9/1998 Ehbets et al.
5,831,718 A 11/1998 Desai et al.
5,834,676 A 11/1998 Elliott
5,845,165 A 12/1998 McMahan
5,859,693 A 1/1999 Dunne et al.
5,887,375 A 3/1999 Watson
5,892,617 A 4/1999 Wallace
5,911,215 A 6/1999 Fisher, Jr.
5,926,260 A 7/1999 Dunne et al.
5,937,562 A 8/1999 Brough
5,944,041 A 8/1999 Kitchens
5,949,529 A 9/1999 Dunne et al.
5,973,315 A 10/1999 Saldana et al.
D421,229 S 2/2000 Imai
6,029,643 A 2/2000 Golfieri
6,070,355 A 6/2000 Day
6,073,352 A 6/2000 Zykan et al.
D432,930 S 10/2000 Sanoner
6,137,564 A 10/2000 Schmidt et al.
6,154,971 A 12/2000 Perkins
6,192,614 B1 2/2001 Cliburn
6,252,706 B1 6/2001 Kaladgew
6,269,581 B1 8/2001 Groh
6,286,796 B1 9/2001 Pugliesi
6,331,887 B1 12/2001 Shiraishi et al.
6,336,285 B1 * 1/2002 Baumer ..... 42/124
6,396,571 B2 5/2002 Ohtomo et al.
6,397,483 B1 6/2002 Perkins
D460,367 S 7/2002 Apotheloz et al.
D460,368 S 7/2002 Apotheloz et al.
D460,369 S 7/2002 Apotheloz et al.
6,425,697 B1 7/2002 Potts et al.
6,450,816 B1 9/2002 Gerber
6,526,956 B1 3/2003 Hankins
D472,826 S 4/2003 Sanoner
6,556,245 B1 4/2003 Holmberg
6,615,531 B1 9/2003 Holmberg
6,624,881 B2 9/2003 Waibel et al.
6,678,988 B1 1/2004 Poff Jr.
6,693,702 B2 2/2004 Rogers
6,704,097 B2 3/2004 Waibel et al.
D488,315 S 4/2004 Natuzzi
6,722,076 B2 4/2004 Nielsen
6,742,299 B2 6/2004 Strand
6,772,076 B2 8/2004 Yamamoto et al.
6,796,038 B2 9/2004 Humphries
6,819,495 B2 11/2004 Shani et al.
6,886,287 B1 5/2005 Bell et al.
6,886,288 B1 5/2005 Yocum et al.
6,932,305 B2 8/2005 Morales et al.
6,988,331 B2 1/2006 Holmberg
7,006,144 B2 2/2006 Holmberg
7,269,920 B2 9/2007 Staley, III
7,390,130 B2 6/2008 Soulvie
2002/0067475 A1 6/2002 Waibel et al.
2002/0078577 A1 6/2002 Aldred
2003/0133092 A1 7/2003 Rogers
2003/0163943 A1 9/2003 Holmberg
2004/0016169 A1 1/2004 Poff Jr.
2004/0051865 A1 3/2004 Stierle et al.
2004/0079018 A1 4/2004 Holmberg
2004/0114129 A1 6/2004 Gogalla et al.
2004/0135991 A1 7/2004 Gogalla et al.
2004/0194364 A1 10/2004 Holmberg
2004/0257437 A1 12/2004 Lesseu
2005/0035245 A1 2/2005 Morales et al.
2005/0195385 A1 9/2005 Holmberg
2005/0246910 A1 11/2005 Mowers
2005/0252062 A1 11/2005 Scrogin et al.
2005/0268521 A1 12/2005 Cox et al.
2006/0010761 A1 1/2006 Staley, III
2007/0031142 A1 2/2007 Moody et al.
2007/0068018 A1 3/2007 Gilmore
2007/0081817 A1 4/2007 Soulvie
2007/0157502 A1 7/2007 Holmberg
2007/0157503 A1 7/2007 Holmberg
2007/0277421 A1 12/2007 Perkins
2008/0000465 A1 1/2008 Holmberg
2008/0060248 A1 3/2008 Pine et al.

FOREIGN PATENT DOCUMENTS

GB 2 024 558 A 1/1980
GB 2 114 770 A 8/1983
WO WO 90/12330 10/1990
WO 2006090356 A1 8/2006
WO 2006133029 A2 12/2006

* cited by examiner

CROSSBOW DEVICE MOUNT

BACKGROUND

For game hunters the ability to record the hunt in an efficient manner is desired. Moreover, the ability to attach other devices such as rangefinders and other electronic devices to the weapon in a manner that does not impede the hunt is also desired. For the reasons stated above and for other reasons stated below which will become apparent to those skilled in the art upon reading and understanding the present specification, there is a need in the art for a mount that can attach a device such an electronic device to a crossbow in an effective and un-intrusive manner.

SUMMARY OF INVENTION

The above-mentioned problems of current systems are addressed by embodiments of the present invention and will be understood by reading and studying the following specification. The following summaries are provided as way of examples and not by way of limitations. Moreover, the summaries may include more or less elements than are in the claims and are merely provided to give the reader a basic understanding of some of the elements of the present invention.

In one embodiment, a crossbow device mount system is provided. The mount system includes a device mount. The device mount has a support portion and a side portion. The support portion is adapted to be coupled to a device. The side portion is adapted to be coupled to a scope on a crossbow.

In another embodiment, another crossbow device mount system is provided, the mount system includes a device mount and a scope ring. The device mount has a support plate adapted to support a device resting thereon. The support plate has a plurality of apertures passing there through. The support plate further has a side plate. The side plate has a mounting rail extending there from. The scope mount ring is adapted to engage the mounting rail. The scope mount ring is further adapted to be coupled to a scope that is mounted on a crossbow.

In yet another embodiment, a method of mounting a device on a crossbow is provided. The method includes attaching device mount to a scope a scope on the crossbow and securing a device to the device mount.

BRIEF DESCRIPTION OF THE DRAWINGS

The present invention can be more easily understood and further advantages and uses thereof more readily apparent, when considered in view of the description of the preferred embodiments and the following figures in which.

In accordance with common practice, the various described features are not drawn to scale but are drawn to emphasize specific features relevant to the present invention. Reference characters denote like elements throughout Figures and text.

DETAILED DESCRIPTION

In the following detailed description, reference is made to the accompanying drawings, which form a part hereof, and in which is shown by way of illustration specific embodiments in which the inventions may be practiced. These embodiments are described in sufficient detail to enable those skilled in the art to practice the invention, and it is to be understood that other embodiments may be utilized and that logical, mechanical and electrical changes may be made without departing from the spirit and scope of the present invention. The following detailed description is, therefore, not to be taken in a limiting sense, and the scope of the present invention is defined only by the claims and equivalents thereof.

Embodiments of the present invention provide a method and system of mounting a device to a crossbow that will not hamper the hunt and is easy to accomplish. In embodiments, a device mount is designed to mount to a scope on the crossbow. A device, such as a video camera, range finder, game caller or the like, is attached to the device mount.

Figure 1:
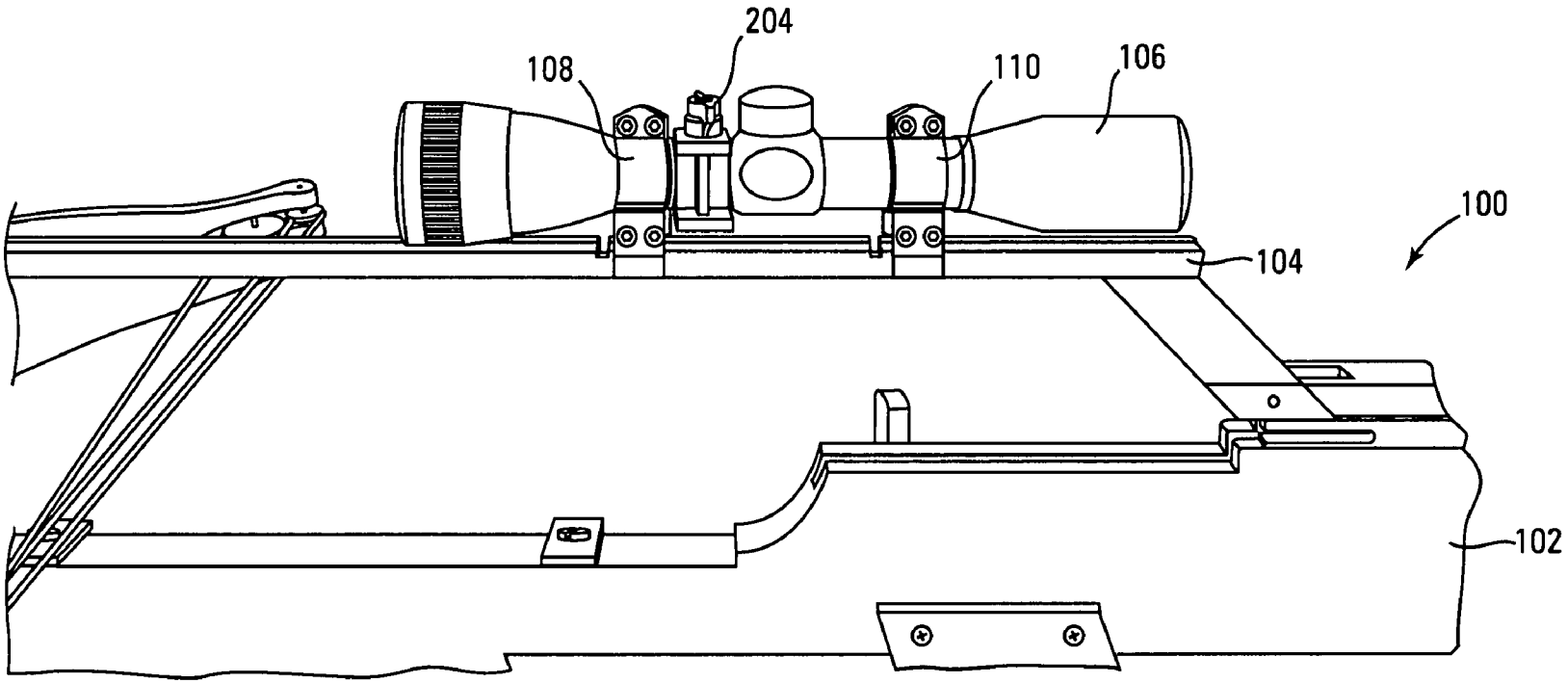
FIG. 1 is a side view of a partial crossbow having a scope mounted thereon and a scope mount ring coupled to the scope to secure a device mount of one embodiment of the present invention.

Referring to FIG. 1, a side view of a crossbow 100 with a scope 106 mounted thereon is illustrated. As illustrated, the crossbow 100 includes a main frame 102 and a rail 104. The scope 106 is mounted to the rail 104 via scope mount rings 108 and 110. Also illustrated in FIG. 1, is a scope mount ring (or scope mount) 204 that is used in at least some embodiments of the present invention to mount a device mount to the scope.

Figure 2:
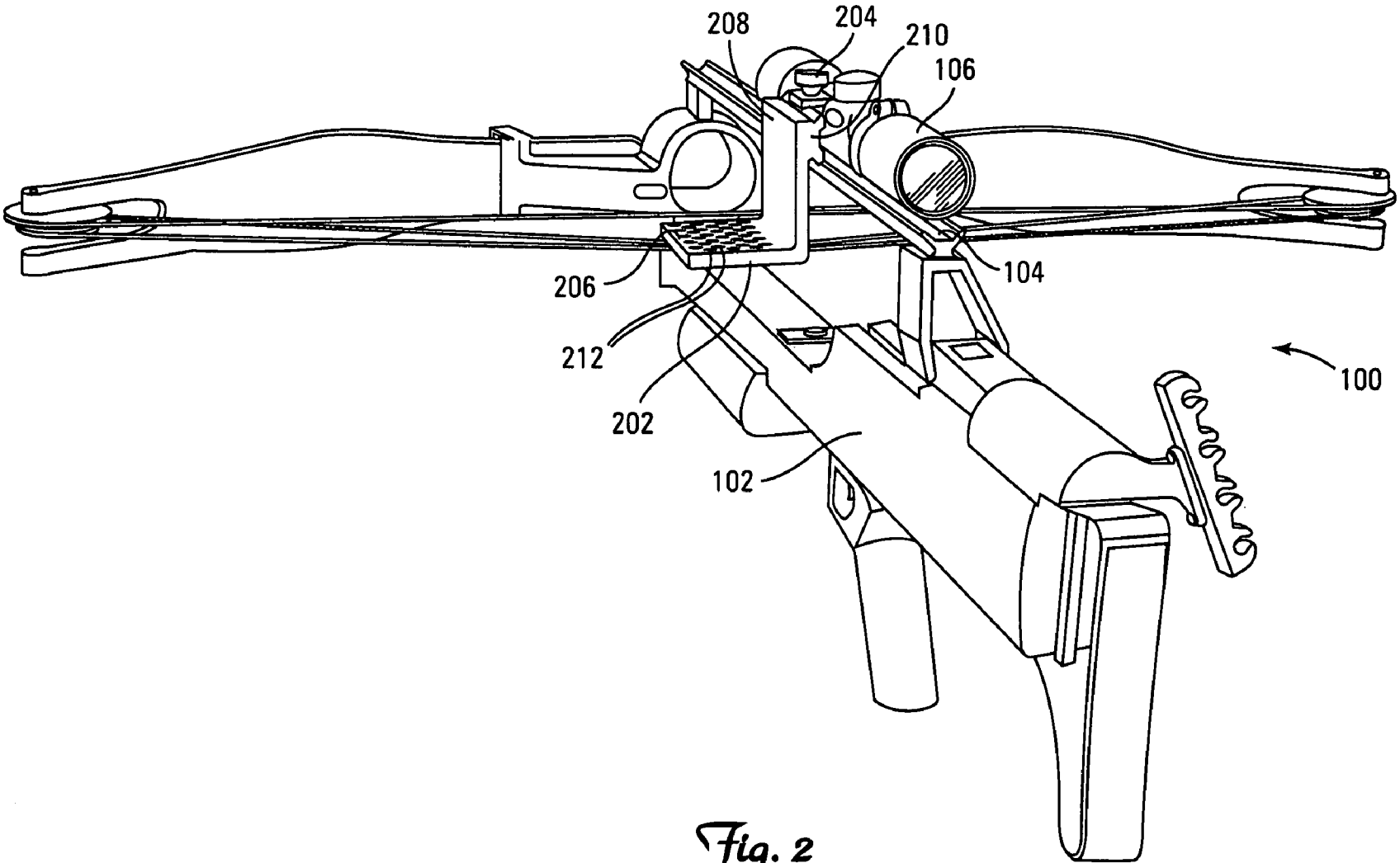
FIG. 2 is a back perspective view of a crossbow including a device mount of one embodiment of the present invention.
Figure 3:
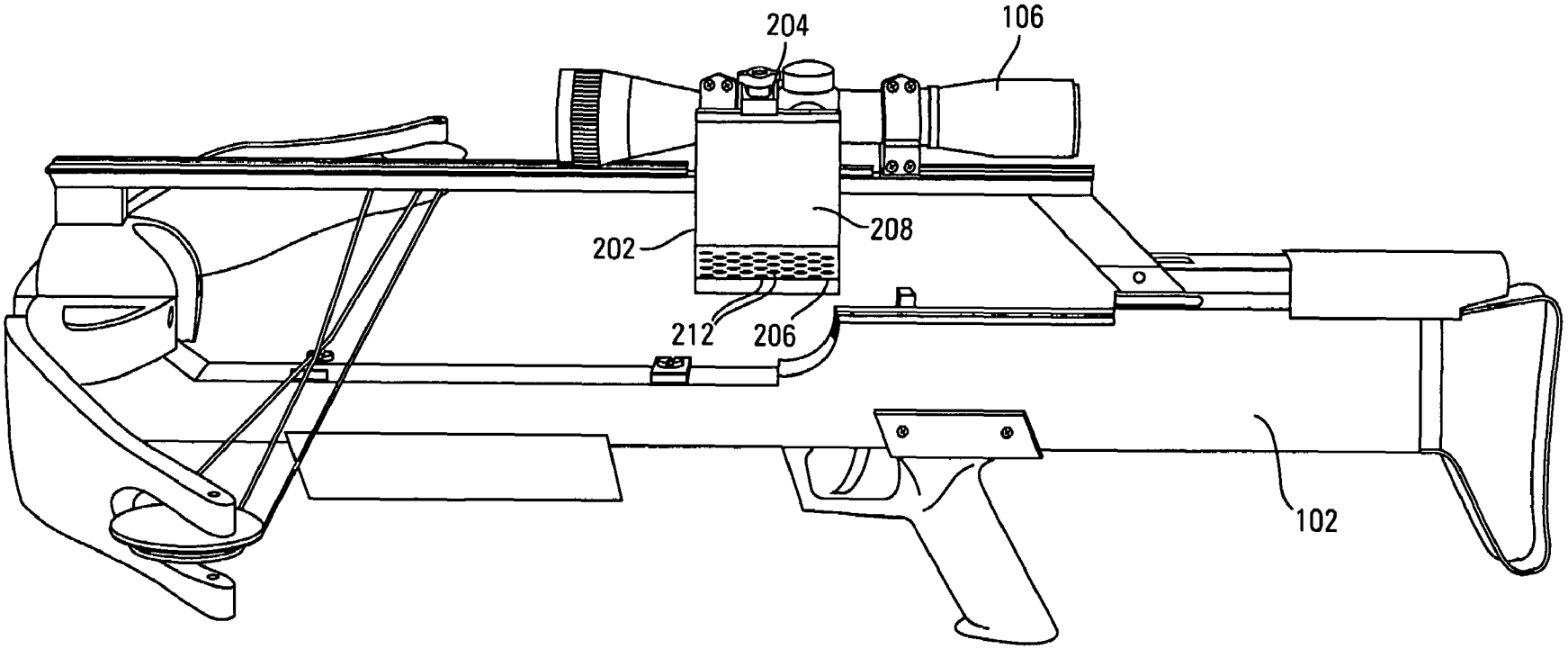
FIG. 3 is a side perspective view of a crossbow including a device mount of one embodiment of the present invention.

Referring to FIG. 2, a back perspective view of the crossbow 100 having a device mount 202 mounted to the scope 106 of one embodiment is illustrated. As illustrated, the device mount 202 includes a support portion or plate 206 and a side portion or plate 208. The support portion 206 has a plurality of mounting apertures 212 passing there through. Also illustrated is a scope mount ring 204 that mounts the device mount 202 to the scope. In particular, the scope mount ring 204 is attached to a mounting rail 210 of the device mount 202 as illustrated. FIG. 3 illustrates a side perspective view of the device mount 202 coupled to the scope 106.

Figure 4:
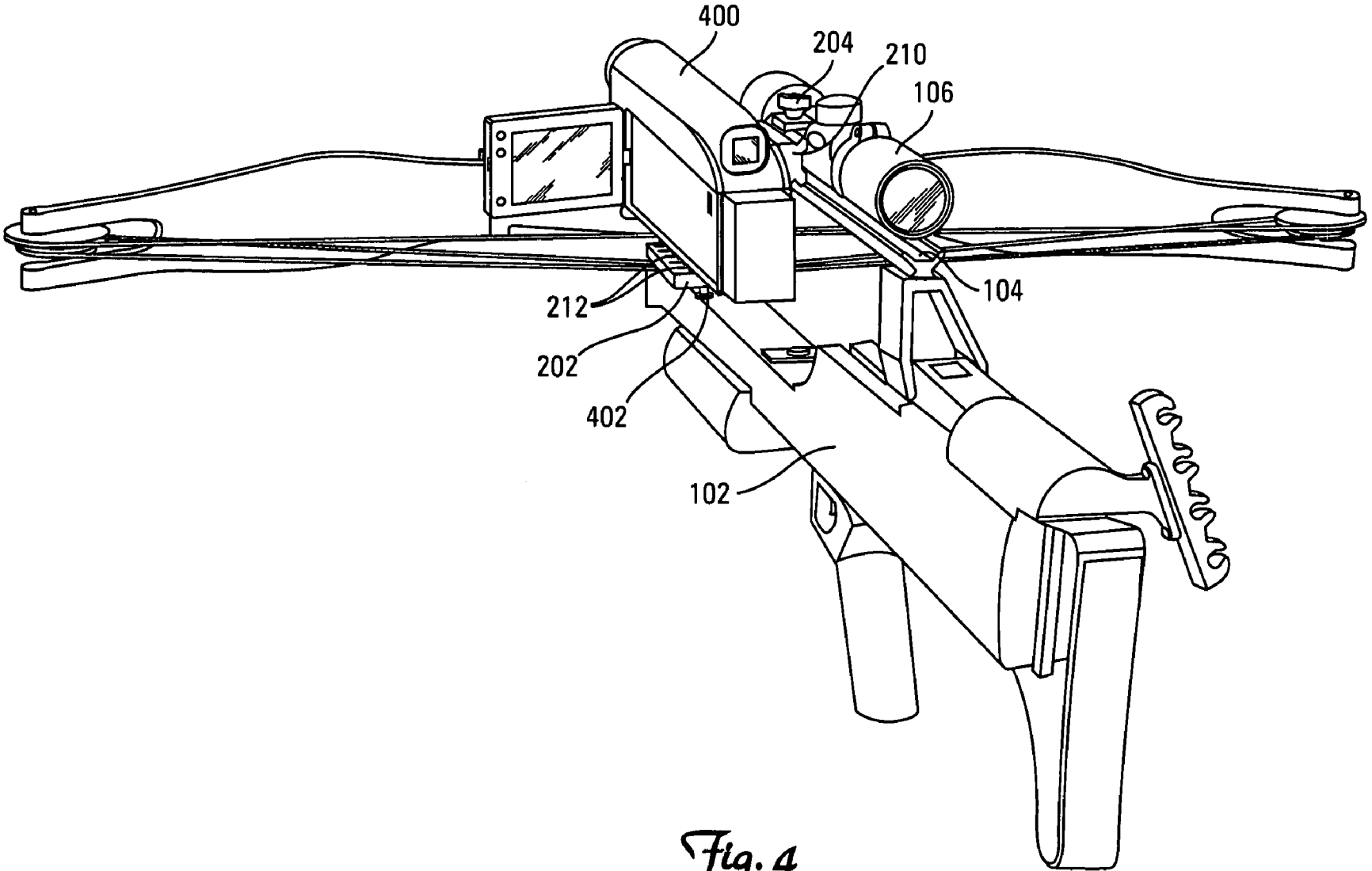
FIG. 4 is a back perspective view illustrating a device on a device mount of one embodiment of the present invention.
Figure 5:
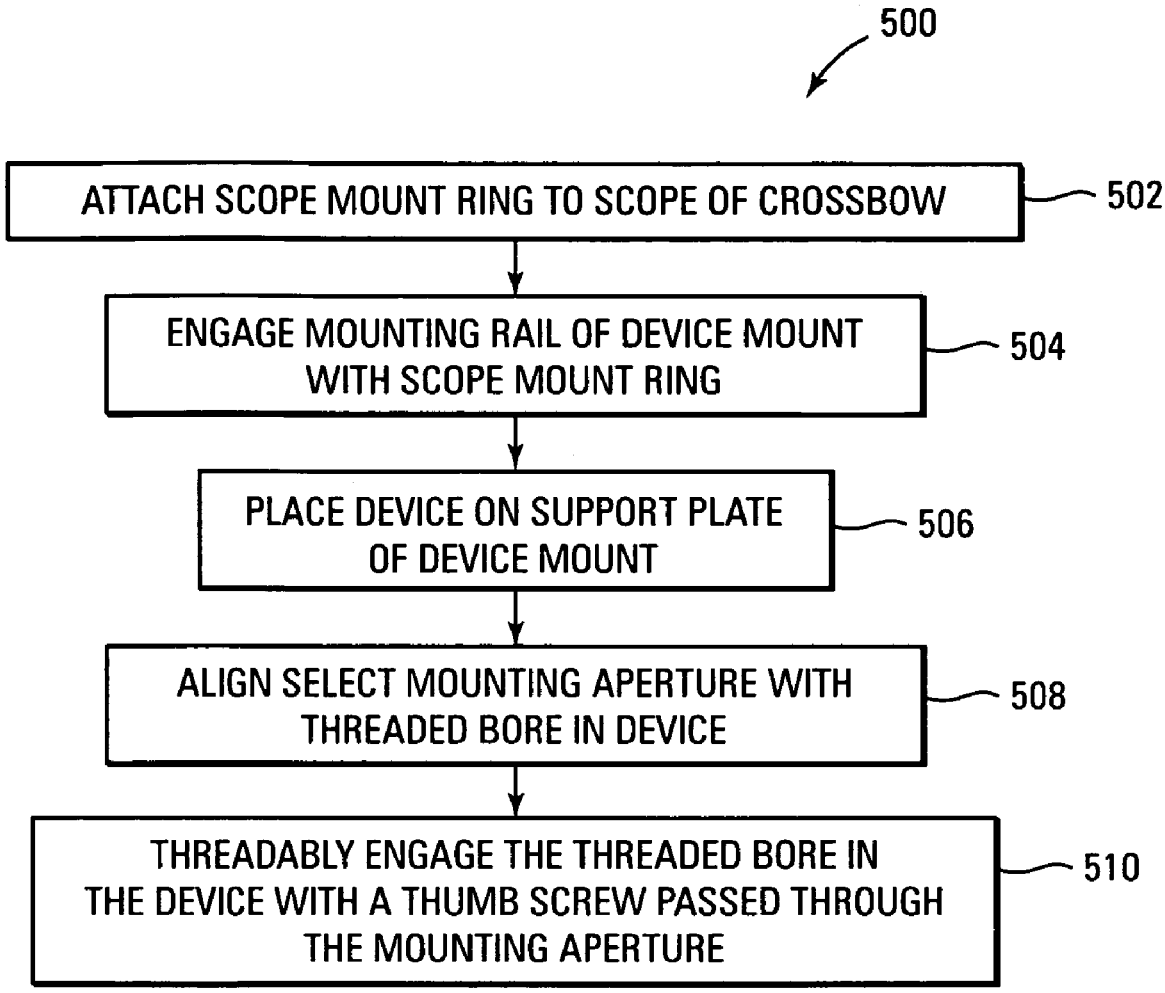
FIG. 5 is a flow diagram illustrating one method of implementing an embodiment of the present invention.

FIG. 4 is a back perspective view of the device mount 202 having a device 400 mounted thereon. In this example, the device is a video camera. However, the device may be any type of device. For example the device could be a rangefinder, a game caller or other device used when hunting. Also illustrated in FIG. 4, is a threaded attaching device 402 such as a thumb screw 402 that attaches the device 400 to the device mount 202 via a selected mount aperture 212. In FIG. 5 a flow diagram 500 illustrating one method of implementing a device mount system to a crossbow 100 is provided. As illustrated, a scope mount 204 is attached to a scope 106 of the crossbow (502). In one embodiment, this is done by positioning a circular bracket of the scope mount 204 around a body of the scope and tightening the circular bracket. A mounting rail 210 of the device mount 202 is engaged with the scope mount 204 (504) to mount the device mount 202 to the scope 106. In, particular the mounting rail 210 of the device mount 204 is received in a receiving track portion of the scope mount 204 (or scope mount ring 204) to mount the device mount 204 to the scope 106. The device 400 to be mounted is placed on a support plate 206 of the device mount (506). The device 400 is then aligned with one of the mounting apertures 212 in the support plate 206 (508). Once the threaded bore in the device 400 is aligned with a select mounting aperture 112 (508), a thumb screw is passed through the mounting aperture and threadably engaged with the threaded bore to mount the device 400 to the device mount 202 (510).

Although specific embodiments have been illustrated and described herein, it will be appreciated by those of ordinary skill in the art that any arrangement, which is calculated to achieve the same purpose, may be substituted for the specific embodiment shown. This application is intended to cover any adaptations or variations of the present invention. Therefore, it is manifestly intended that this invention be limited only by the claims and the equivalents thereof.

The invention claimed is:

1. A crossbow device mount system, the mount system comprising:

a device mount having a support portion and a side portion, wherein (i) the support portion is adapted to be coupled to a device, (ii) the side portion has (1) a first side positioned generally at a right angle to the support portion, (2) a second side having a mounting rail adapted to be coupled to a scope on a crossbow, and (iii) the support portion and the mounting rail are configured and arranged so that when the mount system is coupled to a scope on a crossbow the support portion is positioned below the top of the scope.

2. The mount system of claim 1, wherein the support portion has at least one mounting aperture passing there through.

3. The mount system of claim 2, further comprising:

a thumb screw adapted to pass through the at least one mounting aperture, wherein the thumb screw couples the device to the support portion via the at least one mounting aperture.

4. The mount system of claim 1, further comprising:

a scope mount ring coupled to the scope, the scope mount ring further adapted to be selectively coupled to the mounting rail.

5. The mount system of claim 4, wherein the scope mount ring is a commercially available scope mount ring.

6. A crossbow device mount system, the mount system comprising:

a device mount having a support plate adapted to support a device resting thereon, the support plate having a plurality of apertures passing there through, the support plate further having a side plate, the side plate having a mounting rail extending there from; and a scope mount ring adapted to engage the mounting rail, the scope mount ring further adapted to be coupled to a scope that is mounted on a crossbow.

7. The mount system of claim 6, further comprising:

a thumb screw adapted to pass through a selected one of the plurality of mounting apertures, wherein the thumb screw couples the device to the support portion via the selected mounting aperture.

8. The mount system of claim 6, wherein the scope mount ring is a commercially available scope mount ring.

9. The mount system of claim 6, wherein the device is at least one of a video camera, a range finder and a game caller.

10. A method of mounting a device on a crossbow, the method comprising:

attaching a device mount having a support plate to a scope mounted on a crossbow so as to position the support plate below the top of the scope; and securing a device to the support plate.

11. The method of claim 10, wherein securing the device to the device mount further comprises:

aligning an internally threaded recess in the device with a select one of a plurality of apertures in a support portion of the of the device mount; and engaging the internally threaded recess with external threads on a threaded attaching device positioned through the select aperture.

12. The method of claim 10, wherein securing the device to device mount further comprises:

securing at least one of a video camera, a rangefinder and a game caller to the device mount.

* * * * *